US005531447A

United States Patent [19]

Nagasaka et al.

[11] Patent Number: 5,531,447

[45] Date of Patent: Jul. 2, 1996

[54] GAME DEVICE

[75] Inventors: Yoshizo Nagasaka; Takao Namiki, both of Tokyo, Japan

[73] Assignee: Tomy Company, Ltd., Tokyo, Japan

[21] Appl. No.: 452,579

[22] Filed: May 25, 1995

[30] Foreign Application Priority Data

Aug. 31, 1994 [JP] Japan ..... 6-011917 U

[51] Int. Cl.[6] ..... A63F 3/00

[52] U.S. Cl. ..... 273/249

[58] Field of Search ..... 273/459, 447, 273/243, 237, 248, 249

[56] References Cited

U.S. PATENT DOCUMENTS

| | | | |
|---|---|---|---|
| 2,917,310 | 12/1959 | Durrell | 273/447 X |
| 3,222,066 | 12/1965 | Durrell | 273/447 X |
| 4,157,183 | 6/1979 | Meyer et al. | 273/243 |
| 4,192,512 | 3/1980 | Erickson et al. | 273/243 |
| 4,206,925 | 6/1980 | Goldfarb et al. | 273/248 |
| 4,266,767 | 5/1981 | Spring | 273/447 |
| 4,852,886 | 8/1989 | Zaruba et al. | 273/249 |
| 4,938,481 | 7/1990 | Goldfarb et al. | 273/243 |

*Primary Examiner*—Paul E. Shapiro
*Attorney, Agent, or Firm*—Staas & Halsey

[57] ABSTRACT

A game device including a game plate having a predetermined track formed thereon and at least one piece resting portion provided by said track, a piece which can be rested on the piece resting portion. A running body is provided on the track and having a scooping-up member for scooping up game pieces. A scooping-up member operating mechanism for operating the scooping-up member, wherein the scooping-up member operating means includes a scooping-up driving mechanism for temporarily driving the scooping-up member in the vicinity of said piece resting portion. A restraining mechanism designed to intermittently operate so as to intermittently restrain a part of mechanical elements inside said scooping-up member driving mechanism from operating is also provided.

3 Claims, 5 Drawing Sheets

GAME DEVICE

BRIEF SUMMARY OF THE INVENTION

The present device relates to a game device and more particularly to a game device comprising a piece and a mobile running body.

DESCRIPTION OF THE PRIOR ART

Conventionally, a game device using pieces allows a plurality of players, in turn, to throw a die and advance their own pieces as many positions on a game board as they get on the toss of the die so as to compete against each other in getting their own pieces to a goal.

In a conventional game device, generally, there are provided various kinds of obstacles on the board. Such obstacles are, for instance, "lose a turn," "go back to the starting point," and "skip over to a predetermined position."

However, with a conventional game device, the player must throw a die carefully in his/her desire to get the predetermined number of dots while thinking where to advance his/her piece in order to advance the game piece. Since the player believes it is possible to control the throwing of the die, to some extent, so as to get the desired number of dots in his/her mind, there is a problem that the game device is less thrilling.

SUMMARY OF THE INVENTION

The present device was made in view of the above problem, and an object thereof is to provide a game device which allows the player to be thrilled while playing the game.

A first embodiment provides a game device having a predetermined track formed thereon and at least one position for resting a piece provided by the track, a piece which can be positioned on the piece resting portion, and a running body mobile on the track. The running body has a scooping-up member for scooping up the piece and a scooping-up member operating mechanism for operating the scooping-up member. The scooping-up member operating mechanism includes a scooping-up driving mechanism for temporarily driving the scooping-up member in the vicinity of the piece resting portion and a restraining mechanism designed to intermittently operate to restrain the scooping-up member driving mechanism from operating.

A second embodiment provides a game device similar to the first embodiment, wherein there is a projection provided in the vicinity of the piece resting portion on the track, wherein the scooping-up member driving mechanism includes a lever designed to operate when it is brought into collision with the projection. The driving mechanism also includes a body designed to rotate in a reciprocating manner by virtue of the operation of the lever, and wherein the restraining mechanism includes a ratchet wheel designed to intermittently rotate by virtue of the operation of the lever and a restraining member designed to interlock with the ratchet wheel so as to restrain mechanical elements for transmitting power from the rotating body to the scooping-up member.

In a third embodiment, the restraining member includes a cam having a curved contour which allows the mechanical elements to be restrained from operating in a plurality of different timings.

According to the above-mentioned embodiments, when the part of mechanical elements inside the scooping-up member driving mechanism are restrained from operating by means of the restraining mechanism, the piece placed on the piece resting portion is not scooped up by the piece scooping-up member. But, when the mechanical elements inside the scooping-up member driving mechanism are not restrained from operating by means of the restraining mechanism, it is scooped up by the scooping-up member. Therefore the player can enjoy a thrilled feeling every time the running body passes by his/her piece.

DESCRIPTION OF THE PREFERRED EMBODIMENTS

Figure 1:
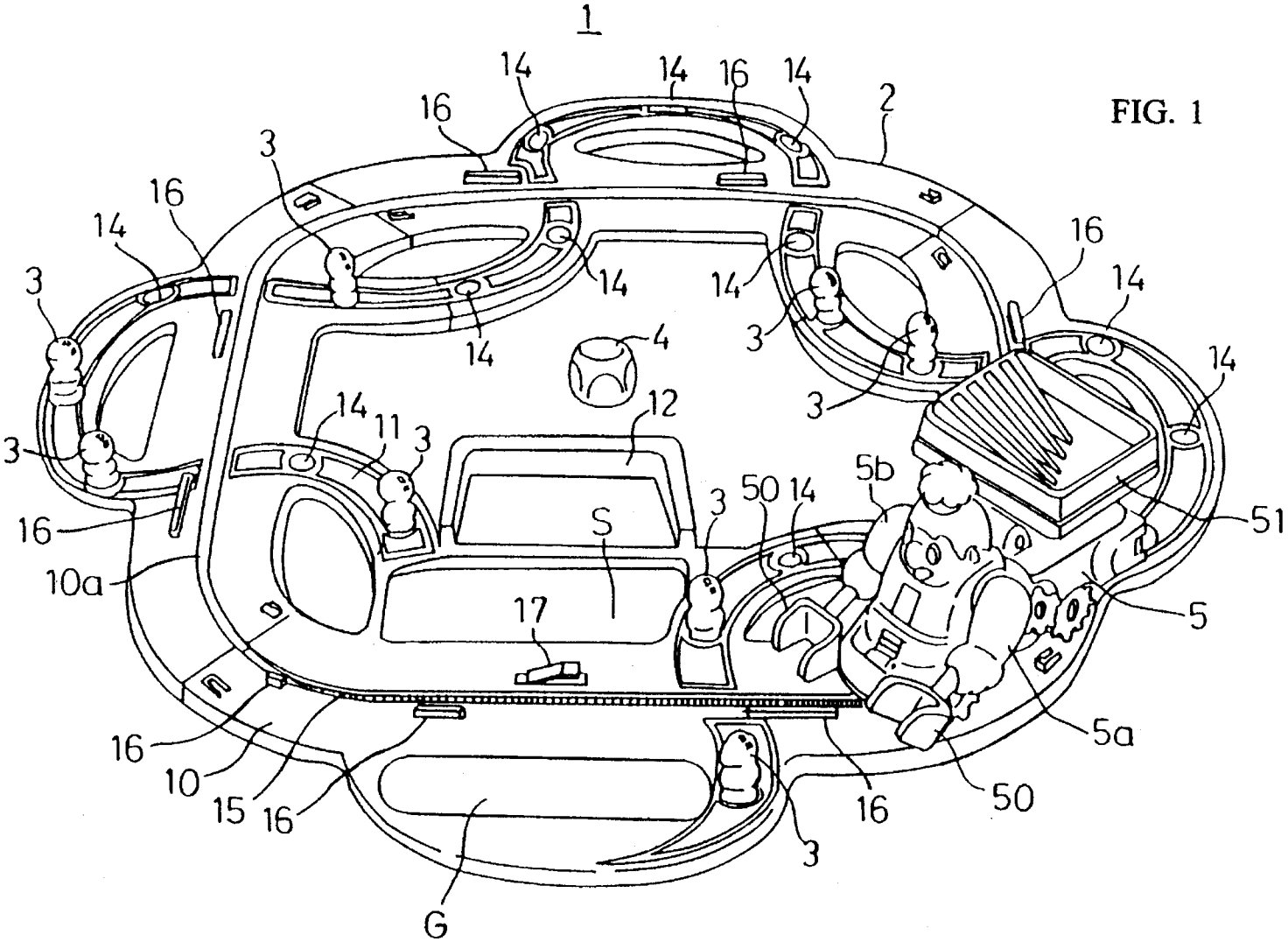
FIG. 1 is a perspective view of a game device of the present invention.

FIG. 1 shows a perspective view of a game device 1 according to one embodiment of the invention. The game device comprises a game plate 2, pieces 3, a die 4 and a running device 5.

In the game plate 2, a clockwise looped track 10 is formed and a course 11 where the pieces 3 are advanced is also provided in such a manner that it intersects with the track 10 as many as seven times through the full length thereof. This course extends from a starting portion S to a goal portion G, and along the length of the course piece resting portions 14, which are indicated as circles in FIG. 1, are provided at predetermined intervals. In the drawing, the pieces 3 are already placed on the piece resting portions 14. Some of the piece resting portions 14 are provided by the track 10, while the others are provided at positions away from the track 10. In addition, a guide groove **10*a* extending along the track 10 is formed at the center of the track 10, and a rack 15 is formed in a side wall of this guide groove 10*a*. Furthermore, at the starting portion S, a first corner and projections 16 are provided on the left-hand side of the guide groove 10*a* of the track 10, the projections 16 being provided just before every portion where the track 10 and the course 11 intersect. Moreover, provided just before the starting portion S on the right-hand side of the guide groove 10*a* of the track 10 is a loading bed tilting projection 17** which is downwardly inclined toward a direction in which the running body advances. In addition, a discharged piece receiving portion 12 is provided radially inwardly of the starting portion S in the game plate 2.

The pieces 3 are to be rested on the piece resting portions 14, and in this embodiment, the pieces 3 are formed into a shape of a peanut. In this embodiment, a plurality of pieces 3, which are different from each other only in color, are prepared, so that a plurality of players take part in a game and each player can have pieces 3 in a color which is distinguished from those of the other players. The die 4 is a normal one having dots from 1 to 6 on each side thereof.

The running body 5 is formed into a shape of a doll at the front portion and into a shape of a dump truck at the rear portion thereof. Right and left hands 5*a*, 5*b* are constructed so as to be vertically moved and scooping-up members 50 are mounted on each of the hands for scooping up the piece 3. A loading bed 51 at the rear portion is for loading the pieces 3 scooped up by the scooping-up members 50 and is constructed so as to be tilted just before the starting portion S to thereby discharge loaded things (the pieces 3) into the discharged piece receiving portion 12.

Figure 2:
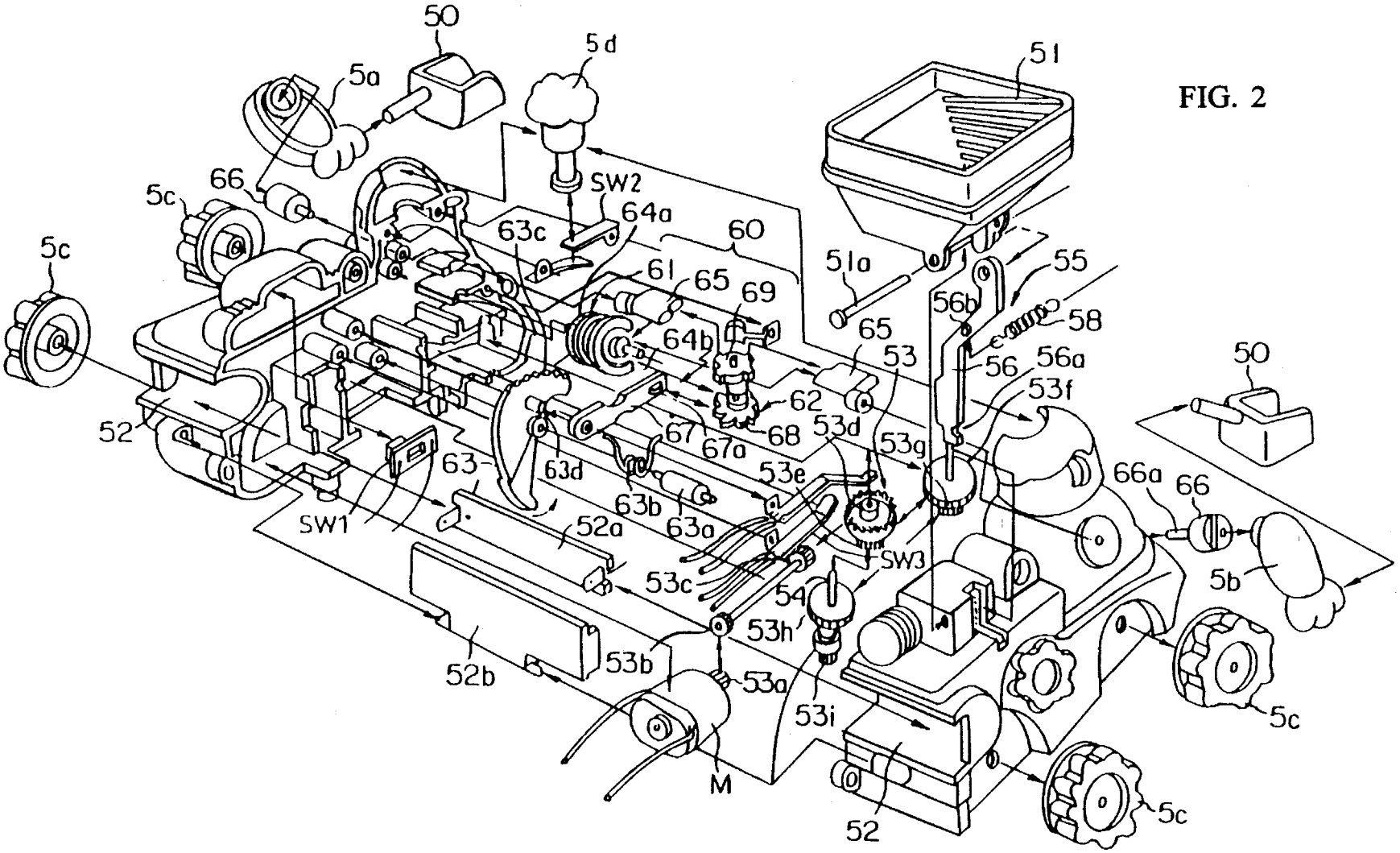
FIG. 2 is an exploded perspective view showing an internal mechanism of a running body of the present invention.
Figure 5:
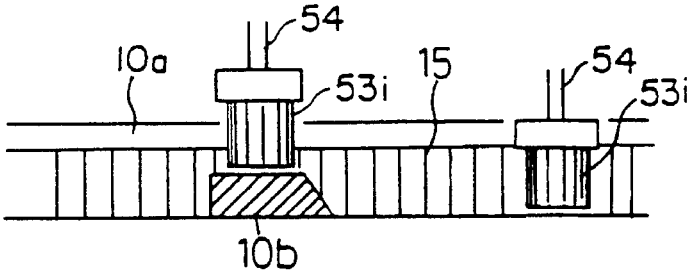
FIG. 5 is a diagram showing a guide groove in a game plate of the present invention.

The running body 5 is configured so as to be mobile on the track 10 by virtue of the power of a motor. In other words, as shown in FIG. 2, a battery storing area 52 is provided in a back portion of the running body 5, and a battery can be stored in this battery storing portion 52. In FIG. 2, reference 52*a* denotes a battery receiver having terminals provided thereon and reference numeral 52*i b* denotes a lid for covering the battery storing portion 52. In addition, provided inside the running body 5 is a motor which is operated by the battery. A running mechanism 53 is connected to this motor M. This running mechanism 53 transmits the power of the motor M to a gear 53*i* via gears 53*a*, 53*b*, 53*c*, 53*d*, 53*e*, 53*f*, 53*g* and 53*h*. As shown in FIG. 5, when gear 53*i* rotates on the rack 15, the running body 5 is made to run. The gears 53*h* and 53*i* are mounted on a vertical shaft 54 and they are also mounted on a main body of the running body so that they do not come off the running body main body and that they can be integrally moved in a vertical direction. In addition, the vertical shaft 54 also constitutes a shaft for the gears 53*d*, 53*e*, which are mounted on the vertical shaft 54 such that they can idly rotate thereon. Wheels 5*c* of the running body 5 are rotatably mounted on the main body thereof.

Figure 4:
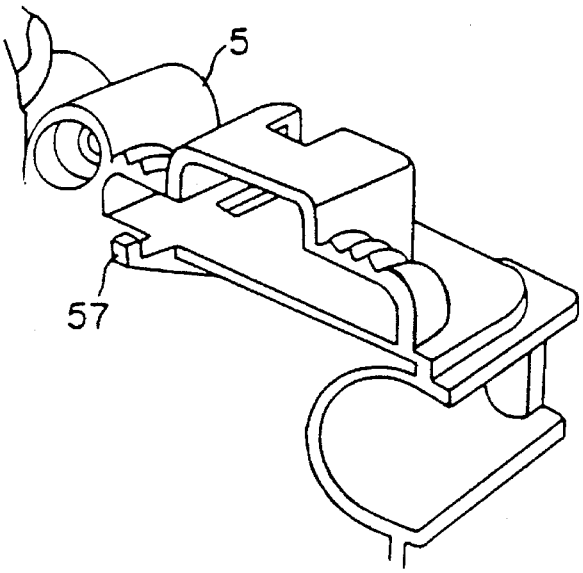
FIG. 4 is a perspective view showing a part of a main body of the running body of the present invention.
Figure 6:
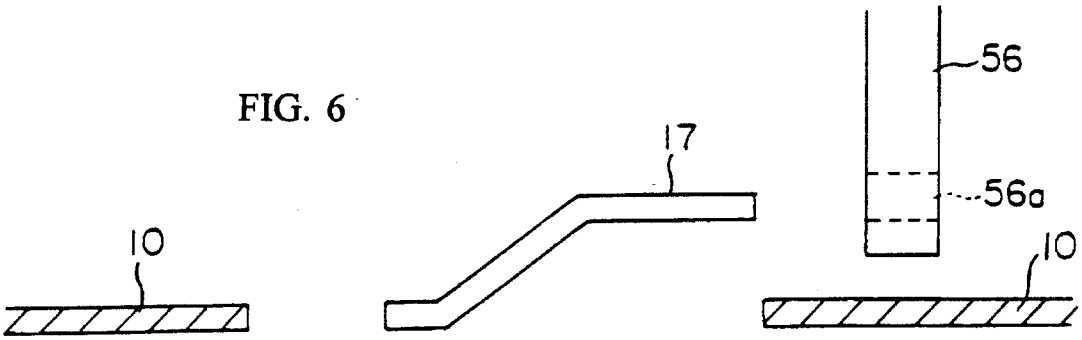
FIG. 6 is a diagram showing a relationship in which a loading bed tilting projection 17 is in engagement with a pushing-up member of the present invention.

The loading bed 5 of the running body 5 is, as shown in FIG. 2, tiltable around a tilting shaft 51*a*, and a loading bed tilting mechanism 55 is connected to this loading bed 51 . This loading bed tilting mechanism 55 includes a pushing-up member 56 that vertically penetrates through the main body of the running body. The pushing-up member 56 is formed into a shape of a crank and an upper end portion thereof is pivotally secured to a position which is eccentric to the tilting shaft 51*a* of the loading bed 51. A U-shaped notch 56*a* is formed in a lower end portion of the pushing-up member 56, and this notch 56*a* is, as shown in FIG. 6, brought into engagement with the loading bed tilting projection 17 on the track 10 just before the starting portion S. In addition, the pushing-up member 56 is upwardly biased by a spring 58 extended between a spring hook portion 56*b* provided at an intermediate portion of the pushing-up member 56 and a spring hook portion 57 (FIG. 4) on the right-hand frame of the main body of the running body. When the running body 5 passes in front of the starting portion S, the pushing-up member 56 is brought into engagement with the loading bed tilting projection 17. The loading bed is then lowered, whereby the loading bed 51 is tilted at the starting portion S, the loaded objects (the pieces 3) being thereby discharged into the discharged piece receiving portion 12. The loading bed 51 is then restored to the original state thereof without any delay.

Furthermore, a scooping-up member operating means 60 is provided on the running body 5. As shown in FIG. 2, this scooping-up member operating means 60 includes a scooping-up member driving means 61 for driving the scooping-up members in the vicinity of the piece resting portions 14 and a restraining mechanism 62 designed to intermittently operate so as to restrain the part of the mechanical elements inside the scooping-up driving mechanism 61 from operating.

Figure 7:
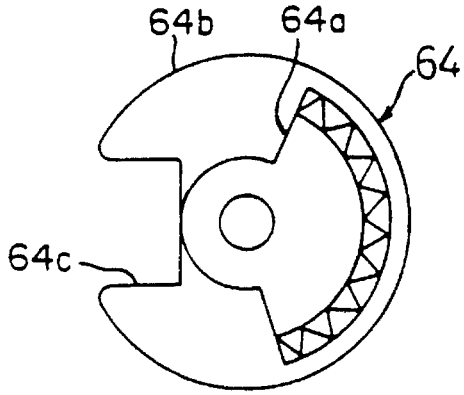
FIG. 7 is a side view of a rotating body of the present invention.

The scooping-up member driving mechanism 61 comprises a lever 63, a rotating body 64, rotating plates 65, and a connecting member 66 for the left hand 5*a* and the right hand 5*b*. The lever 63 is constructed so as to rotate around a shaft 63*a* and is biased in a direction indicated by an arrow in FIG. 2 by virtue of the action of a spring 63*b*. This lever 63 rotates in a direction reverse to the direction indicated by the arrow against the biassing force of the spring 63*b* when it is brought into contact with the projection 16. A partial gear 63*c* is formed in an upper end portion of this lever 63. The rotating body 64 comprises, as shown in FIGS. 2 and 7, a sector gear 64*a* which is in mesh engagement with the partial gear 63*c* and a pillar body 64*b* designed to rotate together with sector gear 64*a*. Of these two members, a U-shaped notch 64*c* is formed in the pillar body 64*b*. The rotating plates 65 each have a notch at an end thereof. These rotating plates 65 are provided on the left and right-hand sides of the main body of the running body and are mounted on a shaft 66*a* of the connecting member 66 for supporting the left hand 5*a* and right hand 5*b*. Each of the rotating plates 65 is in engagement with the notch 64*c* of the pillar body 64*b*. When the rotating body 64 starts to rotate in a reciprocating fashion as the lever 63 operates, the rotating plates 65 are designed to rotate upwardly on a shaft 65*a* (see FIGS. 8 and 9) by being pushed by an lower edge of the notch 64*c*, or rotate downwardly on the shaft 65*a* due to its own weight.

Alternatively, the restraining mechanism 62 comprises a link 67 having a pawl 67*a* affixed thereto, a ratchet wheel 68 adapted to rotate when in engagement with pawl 67*a* of the link 67 and a restraining member 69 designed to interlock with the ratchet wheel 68 so as to restrain the rotating plates 65 from operating. A proximal end of the link 67*a* is pivotally secured to a pin 63*d* of the lever 63. The link 67 is designed to reciprocate as the lever 63 rotates. The restraining member 69 comprises a cam having a curved contour that restrains the rotating plates 65 from operating at a plurality of different timings, and the recessed portions in the contour of the cam function to permit the vertical movements of the rotating plates 65, while the raised portions function to prevent the lowering of the rotating plates 65. The restraining member 69 allows the left and right rotating plates 65 to operated simultaneously or to activate one of the plates individually. In addition, the ratchet wheel 68 has eight teeth, and is designed to rotate tooth after tooth every time the lever 63 operates. Eight teeth are formed in the ratchet wheel 68 since nine projections 16 are spaced around the track, and that provision of teeth equal to, multiplied and divided by the number of projections 16 provided is avoided so as to make the movement of the scooping-up members 50 more irregular to thereby enhance unpredictability.

Next, an electric circuit inside the running body 5 of the present embodiment will be described.

Figure 3:
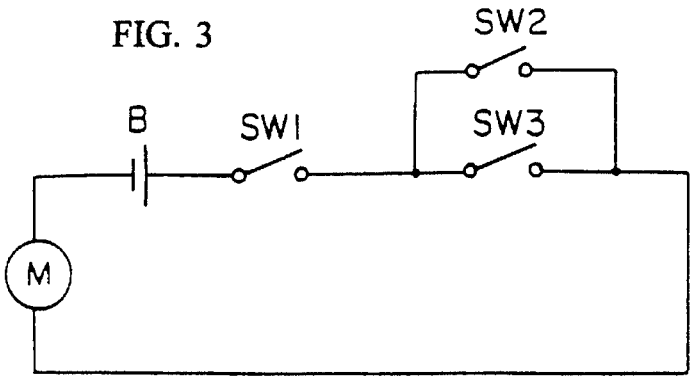
FIG. 3 is an electric circuit diagram of the running body of the present invention.

As shown in FIG. 3, in this electric circuit the motor M and a power supply switch SW1 are connected in series relative to the battery B, while switches SW2 and SW3 are connected in parallel relative to the motor M and the like. The power supply switch SW1 is a slide switch located under the loading bed 51 on the left-hand side of the main body of the running body. The switch SW2 is normally open and is located under a hat 5*d* and it is constructed so as to be closed when the hat 5*d* is pressed down. The switch SW3 is normally closed and is disposed on the vertical shaft 54 and it is constructed so as to be open when the gear 53*i* rides on a projection 10*b* provided in the guide groove 10*a* as shown in FIG. 5 whereby a contact piece on an upper side of switch SW3 is pushed up due to contact with an upper end of the vertical shaft 54. The projection 10*b* inside the guide groove 10*a* is provided just before the starting portion S. Therefore, the switch SW3 is open when the running body is at the starting point, and the motor M is temporarily put in operation by pressing down the hat 5*d* to thereby close the switch SW2. When the running body 5 moves, the engagement between the gear 53*i* and the projection 10*b* is eliminated, whereby the switch SW3 is closed, this making the running body 5 automatically run. In addition, when the running body 5 completes a lap, since the gear 53*i* rides on the projection 10*b* again, the switch SW3 is opened and the running body 5 comes to a halt.

Described next will be one example of how to play with a game device of the present invention together with an operation of the running body 5.

In a case where there are two players participating in a game, two kinds (for instance, two colors) of pieces 3 are prepared for each player. Next, after it is determined who starts to play, i.e., who starts to place his/her own piece on the piece resting portion, a first player throws the die. When the number of dots on the die is set, the piece 3 is advanced from the starting portion S over the number of positions equal to that of dots on the die. Next, the other player throws the die and advance his/her own piece in a similar manner. In this case, when there is already a piece 3 resting on a position where another one is to be placed if advanced in accordance with the number of dots obtained, the another piece 3 is to be placed at a position one place prior to the expected position.

Figure 8:
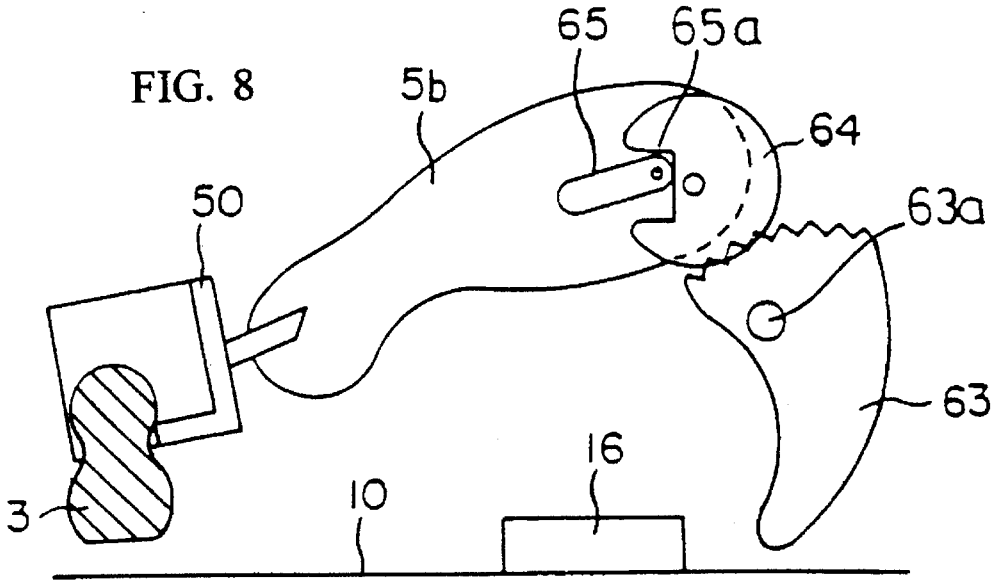
FIG. 8 is a diagram showing an operation of a scooping-up member of the present invention.
Figure 9:
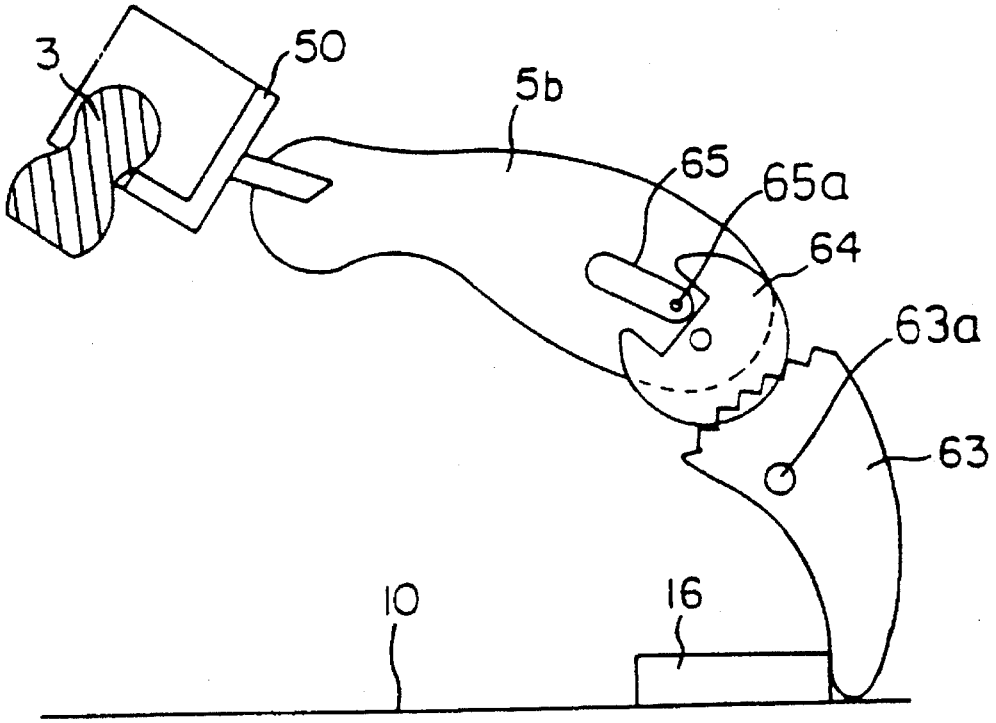
FIG. 9 is a diagram showing another operation of the scooping-up member of the present invention.

When the pieces are set as described above, the power supply switch SW1 is switched on and the switch SW2 is also switched on by pressing down the hat 5*d*, allowing the running body 5 to run a short distance, and the hat 5*d* is then released. This allows the switch SW3 to be automatically switched on, and the running body 5 performs an automatic running. When the running body 5 approaches the first corner, the lever 63 is brought into collision with the projection 16, and the rotating body 64 tries to swing up the rotating plates 65. Even in a case where the scooping-up members 55 are lowered or raised in a state in which the running body has just been started, the scooping-up members 50 are swung up to an upper limit. During that time, the ratchet wheel 68 rotates only through an extent equal to one tooth by virtue of the action of the lever 63. When the ratchet wheel 68 so rotates, the position of the recessed portion of the restraining member 69 interlocking with the ratchet wheel is changed. Then, when the inner end portions of the rotating plates 65 pass through the recessed portion of the restraining member 69, the rotating plates 65 are lowered. In a case where the inner end portions of the rotating plates 65 do not pass through the recessed portion of the restraining member 69 (i.e., where the inner end portions of the rotating plates 65 are brought into abutment with the raised portion of the restraining member 69), the rotating plates 65 remain raised. When the plates are raised, the running body advances to the next projection 16 so as to be brought into contact therewith, the rotating body 64 starts to rotate and tries to swing the rotating plates 65 up. At this moment, as shown in FIGS. 8 and 9, the piece 3 is scooped up by the lowered scooping-up members 50, and the piece 3 is scooped up onto the loading bed 51. The running body 5 runs around the track while repeating the above-mentioned actions. When it nearly completes a lap, the pushing-up member 56 is brought into engagement with the loading bed tilting projection 17 lowered, and thus tilt the loading bed 51 at the starting portion S, whereby the pieces 3 in the loading bed 51 are discharged into the piece discharging portion 12. The loading bed 51 is restored to its original state without any delay after having been tilted. Afterwards, the gear 53*i* rides on the projection 10*b* and the switch SW3 is opened, whereby the running body 5 comes to a halt.

In a case where the pieces 3 are loaded on the loading bed 51 and then discharged back into the piece discharging portion 12, the relative pieces 3 are to be advanced from the starting portion again.

In addition, a plurality of pieces 3 may be moved from the starting portion S, or another piece 3 may be moved after one arrives at the goal portion G.

As described above, to win a game the player will get all his/her pieces 3 to the goal portion earlier than the other.

With the game device 1 configured as described above, the following advantages can be obtained.

With the game device 1 according to the present invention, in a case where the portion of the rotating plates 65 inside the scooping-up member driving mechanism 61 are restrained from operating by means of the restraining mechanism 62, the pieces 3 placed on the piece resting portions 14 are not scooped up by the scooping-up members 50, while in a case where the rotating plates 65 are not restrained from operating by the restraining mechanism 62, they are scooped up by the scooping-up members 50. Therefore, the players can feel thrilled feeling every time the running body 5 passes by his/her own pieces 3.

In addition, the game can be enjoyed by letting the running body run to scoop up pieces 3 placed on the piece resting portions 14 along the track 10 by a plurality of players, who will win or lose the game if their own pieces are not scooped up or scooped up, respectively without advancing the pieces 3 on the course 11.

While the invention has been described with reference to the preferred embodiments, the present invention is not limited to these embodiments and various modifications are possible without departing from the spirit of the present device.

For instance, in the above embodiments, the scooping-up member driving mechanism 61 and regaining mechanism 62 constituting the scooping-up operating means 60 are operated mechanically, but may be operated electrically.

In addition, in the above embodiment, the projections 16 are provided in the vicinity of the portions where the track 10 and the course 11 intersect with each other, but a dummy projection may be provided between the projections 16 in order to enhance excitement. In a case where there is a long distance between the projections 16, it is particularly effective to provide such a dummy projection.

According to the present device, in a case where the part of the mechanical elements inside the scooping-up member driving mechanism are restrained from operating by means of the restraining mechanism, the pieces placed on the piece resting portions are not scooped up by the scooping-up members, while in a case where the rotating plates are not restrained from operating by the restraining mechanism, they are scooped up by the scooping-up members. Therefore, the players can feel thrilled feeling every time the running body passes by his/her own pieces.

We claim:

1. A game, comprising:

a game plate having a predetermined track formed thereon and at least one piece resting portion provided by said track, a projection being provided in the vicinity of said piece resting portion of said track, a piece which can be rested on said piece resting portion, a running body mobile on said track having a scooping-up member for scooping up said piece and scooping-up member operating means for operating said scooping-up member including a scooping-up driving mechanism for temporary driving said scooping-up member while said running body is in the vicinity of said piece resting portion, a restraining mechanism designed to intermittently operate so as to intermittently restrain a portion of said driving mechanism to prevent said scooping-up member driving mechanism from operating, a lever coupled to said scooping-up member driving mechanism which operates, when it is brought into collision with said projection, and a rotating body designed to rotate in a reciprocating manner by virtue of the operation of said lever.

2. A game device as set forth in claim 1, wherein said restraining mechanism comprises:

a ratchet wheel which intermittently rotates by virtue of the operation of said lever; and a restraining member designed to interlock with said ratchet wheel so as to restrain mechanical elements for transmitting power from said rotating body to said scooping-up member.

3. A game device as set forth in claim 1, wherein said restraining mechanism comprises:

a cam having a curved contour which can allow said mechanical elements to be restrained from operating at a plurality of different timings.

* * * * *